US010731423B2

(12) United States Patent
Grimmer et al.

(10) Patent No.: US 10,731,423 B2
(45) Date of Patent: Aug. 4, 2020

(54) MULTI-START THREAD CONNECTION FOR DOWNHOLE TOOLS

(71) Applicant: BAKER HUGHES INCORPORATED, Houston, TX (US)

(72) Inventors: Harald Grimmer, Niedersachsen (DE); Christian Fulda, Sehnde (DE)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

(21) Appl. No.: 15/362,427

(22) Filed: Nov. 28, 2016

(65) Prior Publication Data

US 2017/0074050 A1 Mar. 16, 2017

Related U.S. Application Data

(63) Continuation-in-part of application No. 14/043,541, filed on Oct. 1, 2013, now abandoned.

(51) Int. Cl.
*E21B 17/03* (2006.01)
*E21B 4/02* (2006.01)

(52) U.S. Cl.
CPC ..... *E21B 17/03* (2013.01); *E21B 4/02* (2013.01); *Y10T 403/68* (2015.01)

(58) Field of Classification Search
CPC ..... E21B 17/03; E21B 4/02
See application file for complete search history.

(56) References Cited

U.S. PATENT DOCUMENTS 5,090,497 A 2/1992 Beimgraben et al.
5,447,472 A 9/1995 Ide
5,896,924 A * 4/1999 Carmody ..... E21B 34/066 137/155
2003/0155769 A1 8/2003 Haines
2007/0079988 A1 4/2007 Konschuh et al.
2010/0111592 A1 5/2010 Hassell et al.
2010/0123311 A1 5/2010 Church
2010/0166534 A1* 7/2010 Chagnot ..... E02D 7/16 414/728
2011/0147091 A1 6/2011 Bullin
2012/0176138 A1* 7/2012 Prammer ..... E21B 17/003 324/338
2013/0186669 A1* 7/2013 Chabas ..... E21B 17/028 174/47
2013/0186688 A1 7/2013 Rasmus et al.
2015/0093189 A1 4/2015 Grimmer

FOREIGN PATENT DOCUMENTS

GB 2327247 A 1/1999

OTHER PUBLICATIONS

EP Application No. 14850309.7 Search Report dated May 22, 2017.
PCT/US2017/063295—International Search Report dated Feb. 27, 2018.

* cited by examiner

*Primary Examiner* — Kristyn A Hall
(74) *Attorney, Agent, or Firm* — Mossman Kumar & Tyler PC

(57) ABSTRACT

A wellbore apparatus includes a first component having a first element and a second component having a second element. The first component and the second component are connected by a multi-start thread connection and the first element and the second element being operatively connected to one another.

18 Claims, 3 Drawing Sheets

MULTI-START THREAD CONNECTION FOR DOWNHOLE TOOLS

CROSS-REFERENCE TO RELATED APPLICATIONS

This application is a continuation-in-part of U.S. patent application Ser. No. 14/043,541, filed Oct. 1, 2013, the disclosure of which is incorporated herein by reference in its entirety.

BACKGROUND OF THE DISCLOSURE

1. Field of the Disclosure

This disclosure relates generally to oilfield downhole tools and more particularly to methods and devices for transferring rotary power to a consumer.

2. Description of the Related Art

To obtain hydrocarbons such as oil and gas, boreholes or wellbores are drilled by rotating a drill bit attached to the bottom of a BHA (also referred to herein as a "Bottom Hole Assembly" or ("BHA"). The BHA is attached to the bottom of a drill string, which is usually either a jointed rigid pipe or a relatively flexible spoolable tubing commonly referred to in the art as "coiled tubing." When jointed pipe is utilized, the drill bit is rotated by rotating the jointed pipe from the surface and/or by a mud motor contained in the BHA. In the case of coiled tubing, the drill bit is rotated by the mud motor. BHA's, as well as other wellbore devices, may often incorporate equipment that require the transfer of rotary power from a generator to a consumer; e.g., from a drilling motor to a drill bit. The transfer of such rotary power often occurs across two or more torque transmitting elements such as shafts.

In some aspects, the present disclosure addresses the need for threaded couplings that provide a connection to efficiently transfer energy, signals, and/or fluids while also providing enhanced torque transmitting capabilities during the transfer of rotary power between two or more torque transmitting elements.

SUMMARY OF THE DISCLOSURE

In aspects, the present disclosure relates to an apparatus for transferring rotary power to a consumer in a wellbore. The apparatus may include a conveyance device configured to be disposed in the wellbore; a rotary power source positioned along the conveyance device, the rotary power source generating a torque; and a drive train connected to the rotary power source, the drive train transferring the torque from the rotary power source to a consumer. The drive train includes at least two torque transmitting members connected by a multi-start thread connection that has at least two helically wound intertwined threads.

In aspects, the present disclosure also provides a wellbore apparatus that includes a first component having a first element and a second component having a second element. The first component and the second component may be connected by a multi-start thread connection. The first element and the second element are operatively connected to one another. A related method includes positioning a first element in a first component, positioning a second element in a second component, connecting the first component to the second component using a multi-start thread connection, and operatively connecting the first element to the second element.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to devices and methods for enhanced threaded connections between a driving rotating member and a driven rotating member. Threaded connections for torque transmission from one component to another can become damaged if over-torqued. To increase the torque capacity, the present disclosure uses a multi-start thread to reduce the induced shoulder load between two threaded components for a given torque. Additionally, the "make-up" and "break up" may be faster for such threaded connections. The present disclosure is susceptible to embodiments of different forms. The drawings show and the written specification describes specific embodiments of the present disclosure with the understanding that the present disclosure is to be considered an exemplification of the principles of the disclosure, and is not intended to limit the disclosure to that illustrated and described herein.

Figure 1:
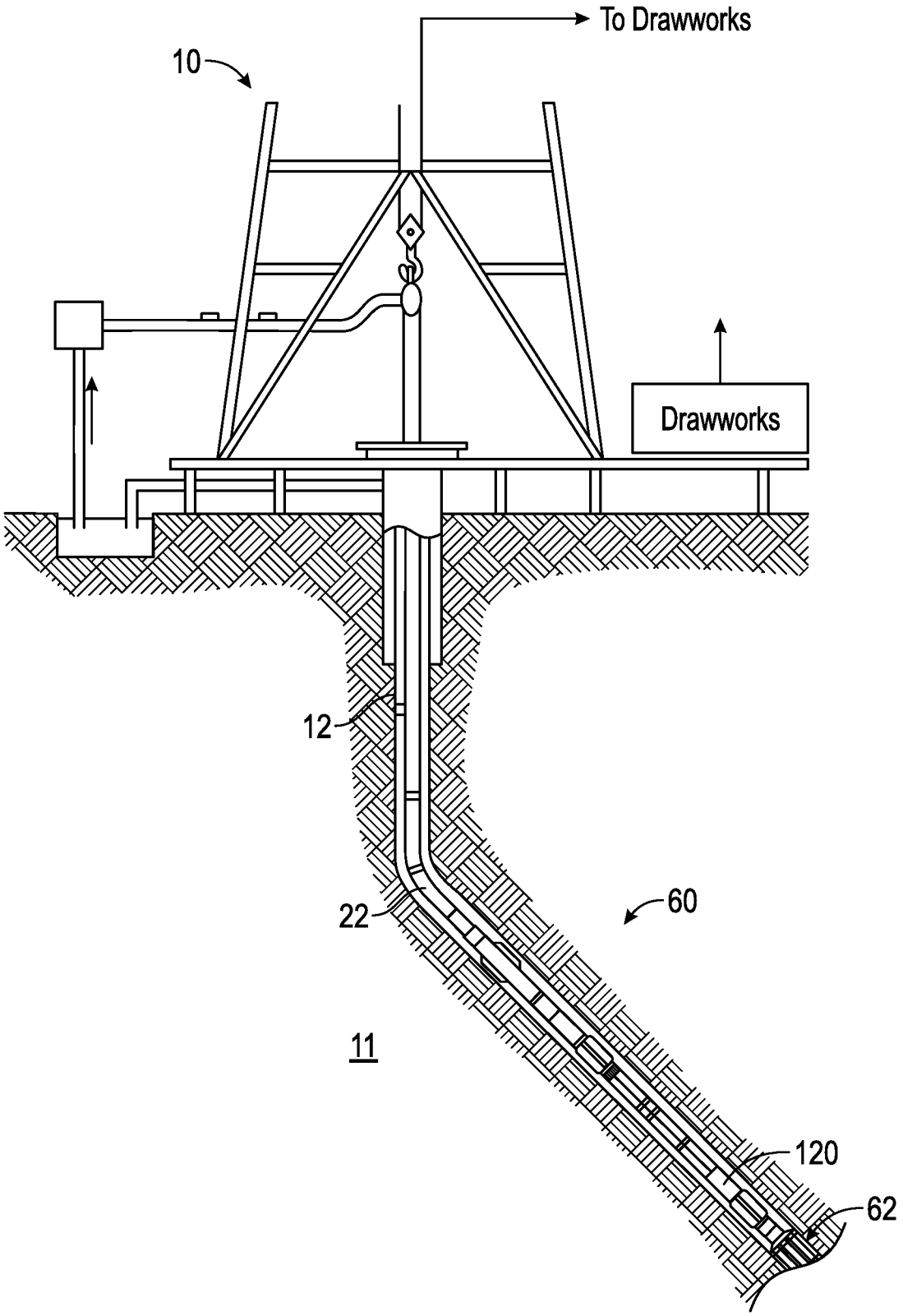
FIG. 1 illustrates a drilling system made in accordance with one embodiment of the present disclosure.

In FIG. 1, there is shown an embodiment of a drilling system 10 utilizing a bottomhole assembly (BHA) 60 configured for drilling wellbores. While a land system is shown, the teachings of the present disclosure may also be utilized in offshore or subsea applications. In FIG. 1, a laminated earth formation 11 is intersected by a wellbore 12. The BHA 60 is conveyed via a drill string 22 into the wellbore 12. The drill string 22 may be jointed drill pipe or coiled tubing, which may include embedded conductors for power and/or data for providing signal and/or power communication between the surface and downhole equipment. The BHA 60 may include a drill bit 62 for forming the wellbore 12. In some embodiments, the BHA 60 may include one or more rotary power sources such as a drilling motor 120.

In a common mode of operation, a pressurized drilling fluid is pumped down to the BHA 60 from the surface via the drill string 22. This flowing drilling fluid may be utilized to energize the drilling motor 120, which generates rotary power that rotates the drill bit 62. The flowing drilling mud can also energize turbines or other similar devices that extract energy from the flowing drilling fluid. The extracted energy may be utilized to generate electricity and/or pressure hydraulic fluids. It should be understood that generating rotary power (i.e., generating useful torque) and electrical power generation and pressuring of fluids are merely illustrative of a variety of functions that may be performed by a consumer of rotary power.

Figure 2:
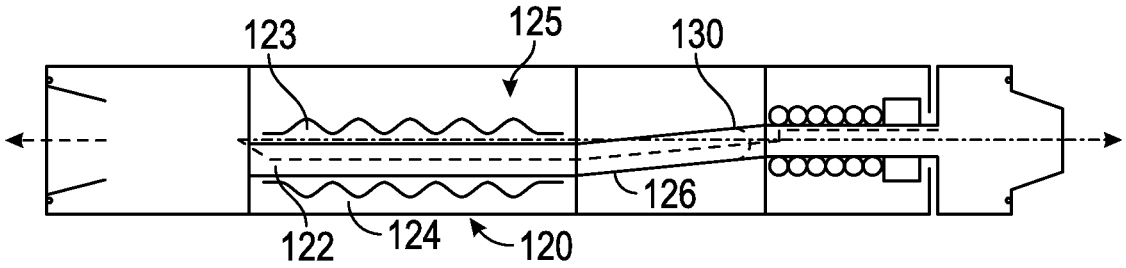
FIG. 2 illustrates a drilling motor assembly using one or more threaded couplings made in accordance with embodiments of the present disclosure.

Referring now to FIG. 2, there is shown in greater detail one embodiment of a drilling motor 120 that may be used with the BHA 60 (FIG. 1). The drilling motor 120 is a positive displacement motor that includes a rotor 122 disposed in a stator 124 forming progressive cavities 123 there between. Fluid supplied under pressure to the motor 120 passes through the cavities 123 and rotates the rotor 122. The rotor 122 in turn is connected to the drill bit 62 (FIG. 1) via a drive train 125 that is formed of two or more interconnected torque transmitting members. In one embodiment, the drive train 125 includes a flex shaft 126 connected to a drive shaft 128 at a pin and box connection 130. The drive train 125 may have a greater or a fewer number of these torque transmitting members.

The drive train 125 can transmit torque from the motor 120 to the drill bit 62 (FIG. 1) using one or more threaded connections. These threaded connections may be used between the rotor 122, the universal joint (e.g. flex shaft) 126, and the drive shaft 128. In certain embodiments, the drive train 125 may also include a rotor adapter and bonnet (not shown) and a segmented drive shaft having upper and lower sections. Threaded connections may also be used transmit torque along these components as well.

Figure 3A:
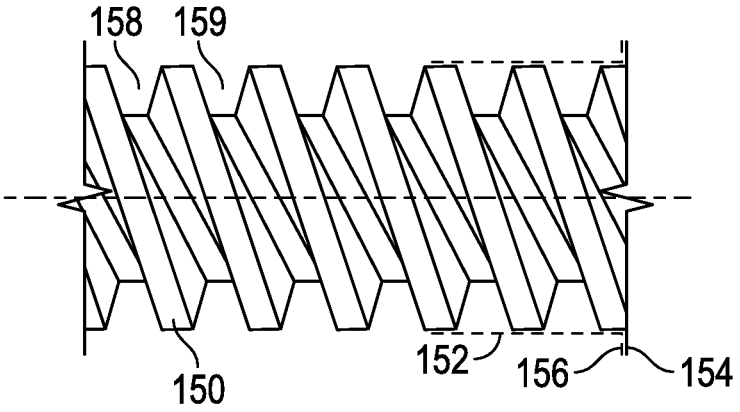
FIG. 3A illustrates a two-start thread configuration in accordance with one embodiment of the present disclosure.

Referring to FIG. 3A, the threaded connection may include a pin end 150 and a box end 152 (shown in hidden lines). In a conventional manner, the pin end 150 has external threads and the box end 152 has internal threads (not shown). The pin end 150 and the box end 152 have abutting shoulders 154, 156, respectively. When the threaded connection is torqued up to a desired value when the pin end 150 and box end 152 are connected (i.e., made up), an axial loading occurs at the shoulders 154, 156. The ratio between a shoulder load and a make-up torque (MUT) depends on thread geometry. If the transmitted torque is higher than MUT, then the connection becomes over-torqued resulting in shoulder or pin damage.

In embodiments, the threaded connections of the drive train 125 (FIG. 2) may use a multi-start thread to reduce the induced shoulder load for a given torque. Reducing the shoulder load may increase the torque capacity of the connection and may therefore avoid the necessity of a double shouldering of a connection. An additional advantage is the faster make and break of long thread cylindrical connections like at the bonnet of a motor. A traditional thread, which is a single start thread, has one helically wound thread. A multi start screw has two or more intertwined threads. The FIG. 3A thread embodiment has two intertwined threads, 158 and 159. The intertwined threads may be helically wound threads. In these screw configurations, the effective pitch is equal to the pitch of a standard thread multiplied by the number of starts.

It should be understood that the drill bit is only one illustrative consumer of rotary power. Other consumers include, but are not limited to, under-reamers, reamers, pipe cutting tools, etc.

Figure 3B:
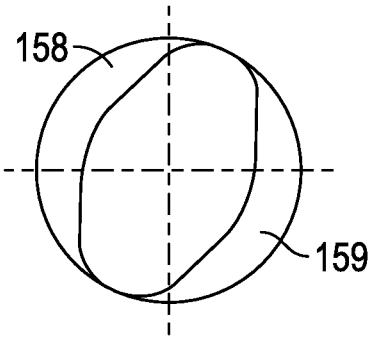
FIG. 3B illustrates an end view of a two-start thread configuration in accordance with one embodiment of the present disclosure.
Figure 4:
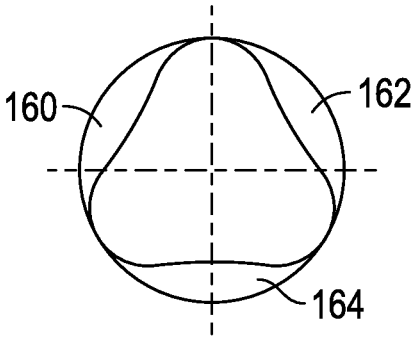
FIG. 4 schematically illustrates an end view of a three-start thread configuration in accordance with one embodiment of the present disclosure.

The number of thread starts may vary depending on application. Thus, the ratio between a make-up torque and a break out torque may also vary significantly. FIG. 3B shows an end view of a two-start thread that has intertwined threads, 158, 159. FIG. 4 show the end view of a three start threads having three intertwined threads, 160, 162, 164. While only up to three thread starts are shown, the number of thread starts may be even higher. The ultimate number of thread starts is reached for an infinite pitch resulting in a pure spline connection. For a relatively high number of thread starts (e.g., five or more depending on pitch and diameter), a potential loss of self locking capability may be addressed with supplemental locking features. Nevertheless, these relatively high thread starts may still be able to transmit bending loads and apply a pre-load (clamping force) on components.

Embodiments of the present disclosure also utilize the multi-start threads in configurations where it is desirable to align two components at a connection. For instance, alignment may be needed to operatively connect components; e.g., enable the transfer or exchange of electrical, optical, acoustic data signals, analog signals, digital signals, power, and/or fluid between components. More generally, the use of multi-start threads can enable an "operative connection" or "operative coupling" that allows energy, power, force, and/or pressure in any form to be conveyed between components that require precise alignment in order to function.

Figure 5:
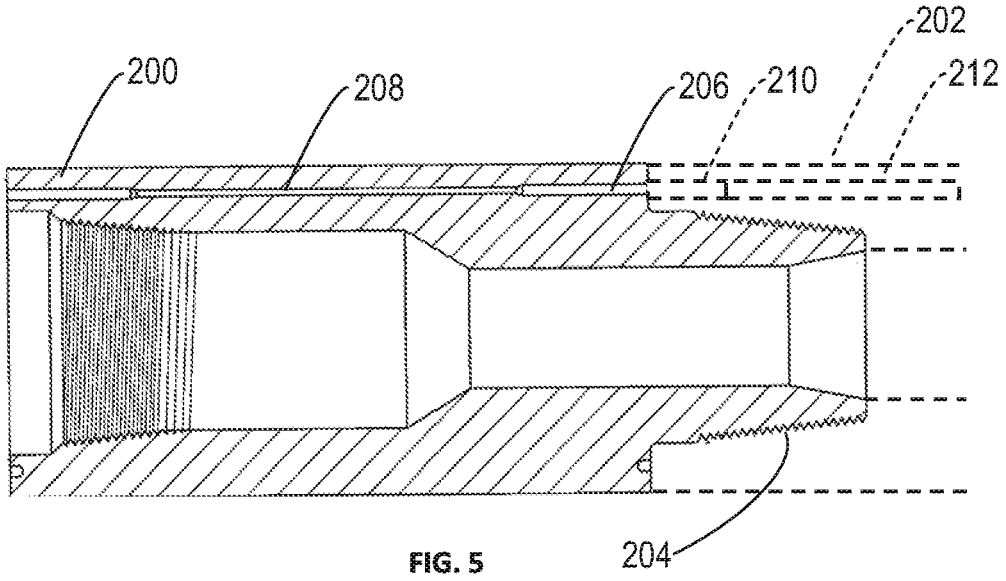
FIG. 5 schematically illustrates a threaded coupling with a line made in accordance with embodiments of the present disclosure.

The advantages of joints or connections with multi-start threads is illustrated in FIG. 5, which shows a first tool section 200 and in dashed lines a second tool section 202. A multi-start thread 204 connects the tool sections 200, 202. The first tool section 200 has a first element 206 associated with a line segment 208 and the second tool section has a second element 210 associated with a line segment 212. The line segments 208, 212 may be parts of one or more components. In order to operatively connect such components, the first element 206 and the second element 210 may need to have a pre-determined relative alignment with a relatively low tolerance. For instance, the orientation may be based on axial alignment, circumferential alignment, radial alignment, angular alignment, longitudinal alignment, or any other suitable reference frame. For example, when the tool sections 200, 202 will be screwed together, the movement of screwing will create a circumferential as well as a longitudinal displacement. By using a multi-start thread, the circumferential as well as the longitudinal displacement is much lower than the displacement in a conventional thread with comparable connection strength. Consequently, the multi-start thread permit applying a specific torque with which the two elements 206, 210 can be oriented to each other at higher accuracy with respect to circumferential and longitudinal displacement. In FIG. 5, the elements 206, 210 are shown as being in physical contact in order to be operatively connected. In embodiments 206, the elements may be contacting surfaces, seals, rings, or other structures configured to forming a mating contact. The elements 206 may also be openings formed in surfaces that mate with one another.

Figure 6:
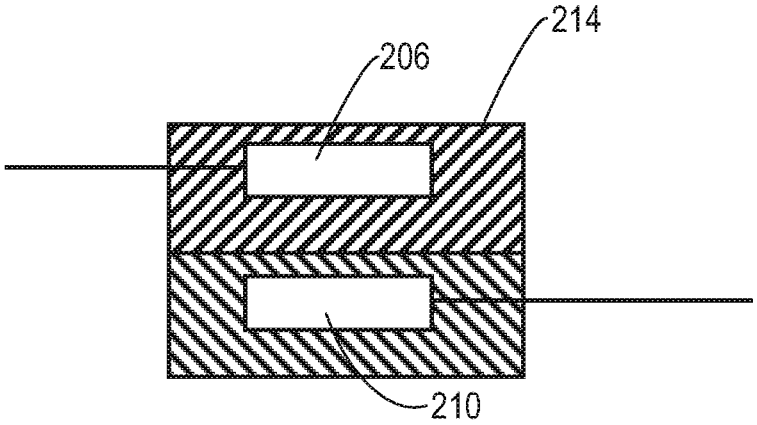
FIG. 6 schematically illustrates a threaded coupling with a non-contact connection made in accordance with embodiments of the present disclosure.

FIG. 6 shows another embodiment wherein the elements 206, 210 are positioned in a coupler 214 and do not require physical contact in order to be operatively connected but still deliver a better performance when aligning them with a higher accuracy. For example, the elements 206, 210 may use couplers utilizing inductive coupling, electromagnetic resonance coupling, capacitive coupling, galvanic coupling, optocouplers, acoustic couplers, and/or transmit/receive signals. The performance of couplers may depend significantly on the circumferential and/or longitudinal alignment of opposing coupler components. Consequently, the coupler performance depends to a much lesser extent on the amount of applied torque with which the first and second components are screwed together.

Figure 7:
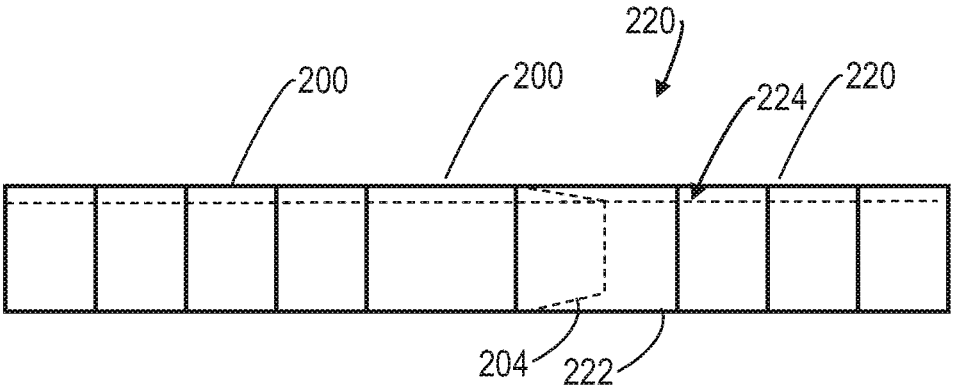
FIG. 7 schematically illustrates an section of a drill string that uses a thread configuration with a line in accordance with one embodiment of the present disclosure.

FIG. 7 schematically illustrates a well tool 220 that may utilize one or more connections according to the present disclosure. The well tool 220 may be a drill pipe, coiled tubing, a section of a BHA, a liner, a casing, or any other tool described above. The well tool 220 has the first tool section 200 and the second tool section 202, which are connected by the multi-start thread 204 at a joint 222. A line 224 may cross the joint 222. Without limitation, the line 224 may be configured to convey one or more of an optical signal, an electrical signal, an acoustic signal, a fluid, and/or other energy streams. The line 224 may be formed of any type of conduit, passage, tube, or a signal carrier, including, but not limited to, a metal wire, fiber optical lines, a hydraulic line, etc. The line 224 may be located centric or eccentric within the well tool 220. While the line is shown to be small compared to the well tool 220 in two dimensions, it may also be shaped to be much larger compared to what is shown in the figures. Further, any number of components may be associated with the line 224, including, but not limited to, one or more sensors, an electromechanic actuator, a hydraulic actuator, an electric pump, a hydraulic pump, a hydraulic consumer, a valve, a piston, an electrical power generator, an electrical power consumer, an electronic component, a microprocessor, a communication device, a sensor, a formation evaluation tool, a BHA orientation sensor, steering devices, drilling motors, etc. including but not limited to surface equipment. Also, while one line 224 is shown, two or more lines may be used.

In some embodiments, the line 224 can cross the thread 204. Using multi-start threads allows the openings in the two connecting threads where the lines run through to be much smaller than when conventional threads are used. In the same way, using multi-start threads allow an alignment with much higher accuracy of opposing coupler components in the connecting threads. When using a multi-start thread, applying a specific torque with lead to a much better accuracy with which the two lines, couplers, contacts, or components can be oriented to each other compared to threads with a conventional design. This allows for reduced size of openings in the two connecting threads where the lines run through which leads to an increase in the stability of the threads. Stated differently, the threaded connection is much less sensitive against overtorque, whereas in conventional threads, the lines would be sheared, contacts would be disconnected, couplers would be misaligned when applying overtorque. In some embodiments, the openings of the line 224 can be formed in the surface(s) on which threads are physically formed.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claim is:

1. A wellbore apparatus, comprising:

a first component having a first element; and a second component having a second element, the first component and the second component being connected by a multi-start thread connection, the first element and the second element being operatively connected to one another only when the first element and the second element have a pre-determined relative angular alignment, wherein the specified pre-determined relative angular alignment occurs only after a specified torque being applied to the multi-start connection, wherein the first component has at least one shoulder and the second component has at least one shoulder, and the specified torque is applied after the at least one shoulders of the first component and the second component are abutting one another.

2. The wellbore apparatus of claim 1, wherein the first element and the second elements are each a segment of a line, and wherein the first element is eccentrically positioned in the first component and the second element is eccentrically positioned in the second component.

3. The wellbore apparatus of claim 2, wherein the line is configured to convey one of: (i) an optical signal, (ii) an electrical signal, (iii) an acoustic signal, (iv) a fluid, (v) energy.

4. The wellbore apparatus of claim 1, further comprising a coupler operatively connecting the first element with the second element.

5. The wellbore apparatus of claim 4, wherein the coupler forms an induction coupling between the first element and the second element.

6. The wellbore apparatus of claim 4, wherein the coupler forms an electromagnetic resonance coupling between the first element and the second element.

7. The wellbore apparatus of claim 4, wherein the coupler forms a capacitive coupling between the first element and the second element.

8. The wellbore apparatus of claim 4, wherein the coupler forms a physical contact between the first element and the second element.

9. The apparatus of claim 1, wherein the first element is one of: a wire, a sensor, a hydraulic pump, a hydraulic line, a hydraulic consumer, an electrical power generator, an electrical power consumer, an electromechanic actuator, a hydraulic actuator, an electric pump, a hydraulic consumer, a valve, a piston, an electronic component, a microprocessor, a communication device, a formation evaluation tool, a BHA orientation sensor, a steering devices, and a drilling motor.

10. The wellbore apparatus of claim 1, wherein the first component is one of: (i) a drill pipe, (ii) coiled tubing, (iii) a section of a BHA, (iv) a liner, (v) a casing; and the second component is one of: (i) a drill pipe, (ii) coiled tubing, (iii) a section of a BHA, (iv) a liner, (v) a casing.

11. A method for forming a connection in a wellbore apparatus, comprising:

positioning a first element in a first component and an associated first opening;

positioning a second element in a second component and an associated second opening;

connecting the first component to the second component using a multi-start thread connection; and operatively connecting the first element and the second element only by placing the first opening and the second opening in a pre-determined relative angular alignment, and one of: (i) a radial pre-determined alignment, and (ii) a pre-determined longitudinal alignment, wherein the specified pre-determined relative angular alignment occurs only after a specified torque being applied to the multi-start connection, wherein the first component has at least one shoulder and the second component has at least one shoulder, and the specified torque is applied after the at least one shoulders of the first component and the second component are abutting one another.

12. The method of claim 11, wherein the first element and the second elements are each a segment of a line, and wherein the first element is eccentrically positioned in the first component and the second element is eccentrically positioned in the second component.

13. The method of claim 12, further comprising using the line to convey one of: (i) an optical signal, (ii) an electrical signal, (iii) an acoustic signal, (iv) a fluid, (v) energy.

14. The method of claim 11, further comprising operatively connecting the first element with the second element using a coupler.

15. The method of claim 14, wherein the coupler forms at least one of: an induction coupling between the first element and the second element; an electromagnetic resonance coupling between the first element and the second element.

16. The method of claim 14, wherein the coupler forms a coupling between the first element and the second element that is one of: galvanic and capacitive.

17. The method of claim 14, wherein the coupler forms a hydraulic coupling between the first element and the second element.

18. The method of claim 11, wherein the first element is one of: (i) a wire, (ii) a sensor, (iii) a hydraulic pump, (iv) a hydraulic line (v) a hydraulic consumer, (vi) an electrical power generator, and (vii) an electrical power consumer.

* * * * *